US011615932B2

(12) United States Patent
Zhang et al.

(10) Patent No.: US 11,615,932 B2
(45) Date of Patent: Mar. 28, 2023

(54) PLUGGABLE CONNECTING DEVICE FOR CONTACTORS AND A CONTACTOR

(71) Applicant: EATON ELECTRICAL LTD., Suzhou (CN)

(72) Inventors: Luming Zhang, Suzhou (CN); Guoyong Ping, Suzhou (CN); Zhenzhen Yin, Suzhou (CN); Zhengning Hu, Suzhou (CN)

(73) Assignee: Eaton Electrical Ltd., Suzhou (CN)

( * ) Notice: Subject to any disclaimer, the term of this patent is extended or adjusted under 35 U.S.C. 154(b) by 136 days.

(21) Appl. No.: 16/985,821

(22) Filed: Aug. 5, 2020

(65) Prior Publication Data

US 2021/0043405 A1 Feb. 11, 2021

(30) Foreign Application Priority Data

Aug. 5, 2019 (CN) ..... 201921256955.8

(51) Int. Cl.
*H01H 50/54* (2006.01)
*H01H 50/44* (2006.01)
(Continued)

(52) U.S. Cl.
CPC ..... *H01H 50/443* (2013.01); *H01H 50/048* (2013.01); *H01H 50/14* (2013.01)

(58) Field of Classification Search
CPC .... H01H 50/443; H01H 50/048; H01H 50/14; H01R 9/2666
(Continued)

(56) References Cited

U.S. PATENT DOCUMENTS 2,753,492 A * 7/1956 Jay ..... A01J 5/06 361/173
5,576,676 A * 11/1996 Koller ..... H01H 50/08 361/819
(Continued)

FOREIGN PATENT DOCUMENTS

CN 207883619 * 9/1918 ..... H01H 50/44
CN 207883619 U 9/2018
(Continued)

OTHER PUBLICATIONS

European Extended Search Report, Application No. 20189720.4, dated Jan. 18, 2021, 9 pps.

*Primary Examiner* — Shawki S Ismail
*Assistant Examiner* — Lisa N Homza
(74) *Attorney, Agent, or Firm* — Stanek Lemon Crouse & Meeks, P.A.

(57) ABSTRACT

The present disclosure provides a pluggable connecting device for a contactor and a contactor, the contactor including a housing, a coil framework located inside the housing, the coil framework provided with a first and a second connecting sheet, and an electromagnetic coil wound on the coil framework, two ends of the electromagnetic coil electrically connected to the first and second connecting sheets. The pluggable connecting device includes an insulated connecting member, and a first and second conductive elements which are fixedly connected with the insulated connecting member. The first conductive element is provided with an insertion end and a wiring end which are arranged oppositely, the second conductive element is provided with an insertion end and a wiring end which are arranged oppositely, and the insertion ends of the first and second conductive elements are configured for connection with the first
(Continued)

and second connecting sheets respectively in a pluggable manner.

8 Claims, 6 Drawing Sheets

(51) Int. Cl.
*H01H 50/04* (2006.01)
*H01H 50/14* (2006.01)

(58) Field of Classification Search
USPC ..... 335/2
See application file for complete search history.

(56) References Cited

U.S. PATENT DOCUMENTS

2008/0174391 A1* 7/2008 Bolz ..... H01H 50/443
335/202
2020/0168418 A1* 5/2020 Chen ..... H01H 50/18

FOREIGN PATENT DOCUMENTS

CN 209045441 U 6/2019
DE 102004009650 B3 7/2005

* cited by examiner

PLUGGABLE CONNECTING DEVICE FOR CONTACTORS AND A CONTACTOR

CROSS REFERENCE TO RELATED APPLICATIONS

This patent application claims the benefit and priority of Chinese Patent Application No. 201921256955.8 filed on Aug. 5, 2019, the disclosure of which is incorporated by reference herein in its entirety as part of the present application.

BACKGROUND

The present disclosure relates to a switch device, in particular to a pluggable connecting device for a contactor and a contactor.

A contactor is a kind of switch device used to switch on or off a circuit, which is commonly used in occasions such as electric power, power distribution, and power utilization. The contactor includes an electromagnetic mechanism, a contact system, a transmission mechanism, a spring and a housing, among which the electromagnetic mechanism is one of the important components. The electromagnetic mechanism includes a static iron core, a moving iron core, a coil framework sleeved on the static iron core, and an electromagnetic coil wound on the coil framework. The operating principle of the contactor is described as follows. When the electromagnetic coil of the contactor is energized, a strong magnetic field will be generated, which will make the static iron core generate a magnetic force and attract the moving iron core, and the moving iron core drives a contact to move to make a normally closed contact open or a normally open contact closed, and when the electromagnetic coil is de-energized, the magnetic force disappears and the moving iron core is released under the action of the spring, which makes the normally closed contact closed or the normally open contact open.

An existing contactor is provided with electromagnetic coil interfaces at two opposite ends, and a power supply is transmitted to the electromagnetic coil through the electromagnetic coil interfaces to control an on-off of the contactor. However, the existing contactor has inconvenient wiring, repeated wiring and complex wiring line and so on. Moreover, the existing contactor cannot intuitively judge the energization of the electromagnetic coil or the on-off condition of the contactor.

BRIEF DESCRIPTION

In view of the above technical problems in the existing art, an embodiment the present disclosure provides a pluggable connecting device for a contactor, the contactor including a housing, a coil framework located inside the housing, the coil framework being provided with a first connecting sheet and a second connecting sheet which are arranged oppositely, and an electromagnetic coil wound on the coil framework, two ends of the electromagnetic coil being electrically connected to the first connecting sheet and the second connecting sheet, respectively, wherein the pluggable connecting device includes an insulated connecting member, and a first conductive element and a second conductive element which are fixedly connected with the insulated connecting member, the first conductive element being provided with an insertion end and a wiring end which are arranged oppositely, the second conductive element being provided with an insertion end and a wiring end which are arranged oppositely, and the insertion end of the first conductive element and the insertion end of the second conductive element being configured for connecting with the first connecting sheet and the second connecting sheet of the contactor, respectively, in a pluggable manner.

The housing of the contactor may include an electrode top plate and a mounting bottom plate which are arranged oppositely, the pluggable connecting device is U-shaped, and the pluggable connecting device is perpendicular to the electrode top plate and is configured to pass through the electrode top plate to be inserted into the housing.

The insertion end of the first conductive element may be provided with two first clamping parts arranged oppositely, and a slot may be defined between the two first clamping parts, and the insertion end of the second conductive element may be provided with two second clamping parts arranged oppositely, and a slot is defined between the two second clamping parts.

The two first clamping parts may be respectively provided with two projections away from each other, and the two second clamping parts may be respectively provided with two projections away from each other.

The first conductive element may include a step part arranged between the insertion end and the wiring end of the first conductive element, and the second conductive element may include a step part arranged between the insertion end and the wiring end of the second conductive element.

The wiring end of the first conductive element may be provided with a bending part, the wiring end of the second conductive element may be provided with a bending part, and the bending part of the first conductive element and the bending part of the second conductive element extend in a direction getting close to each other.

The insulated connecting member may be molded by injection molding, which includes an operation connecting part, and a first wrapping part and a second wrapping part which are fixedly connected with two ends of the operation connecting part, wherein the first wrapping part wraps the first conductive element and makes the insertion end of the first conductive element extend out, and the second wrapping part wraps the second conductive element and makes the insertion end of the second conductive element extend out.

One end of the operation connecting part may define a first accommodation space with an opening, and the other end of the operation connecting part may define a second accommodation space with an opening, the bending part of the first conductive element is located in the first accommodation space, and the bending part of the second conductive element is located in the second accommodation space.

The operation connecting part may be provided with a recess arranged opposite to the electrode top plate.

An embodiment the present disclosure provides a contactor, which includes a housing including an electrode top plate and a mounting bottom plate which are arranged oppositely, the electrode top plate being provided with a first expansion hole and a second expansion hole, a coil framework located inside the housing, the coil framework being provided with a first connecting sheet and a second connecting sheet which are arranged oppositely, and an electromagnetic coil wound on the coil framework, two ends of the electromagnetic coil being electrically connected to the first connecting sheet and the second connecting sheet, respectively, wherein the first connecting sheet and the second connecting sheet are configured for connecting with the insertion end of the first conductive element and the insertion end of the second conductive element in the above pluggable connecting device, respectively, in a pluggable manner.

The coil framework may include a framework body, and a first fixing part and a second fixing part which are fixed on an end face of the framework body, wherein the first connecting sheet and the second connecting sheet are respectively fixed in the first fixing part and the second fixing part, the first connecting sheet and the first fixing part are respectively provided with a first through hole and a first auxiliary hole which are aligned with the first expansion hole, and the second connecting sheet and the second fixing part are respectively provided with a second through hole and a second auxiliary hole which are aligned with the second expansion hole.

The contactor further may include the pluggable connecting device as described above.

The pluggable connecting device according to the present disclosure can be connected with the contactor in a pluggable manner, which improves the convenience of the contactor wiring, and can conveniently supply power to the electromagnetic coil in the contactor or monitor an electric signal in the electromagnetic coil.

BRIEF DESCRIPTION OF THE DRAWINGS

The embodiment of the disclosure is further described with reference to the drawings, in which.

DETAILED DESCRIPTION

Technical solutions and advantages of the present disclosure will be clearer from a detailed description of embodiments of the present disclosure in conjunction with the drawings.

Figure 1:
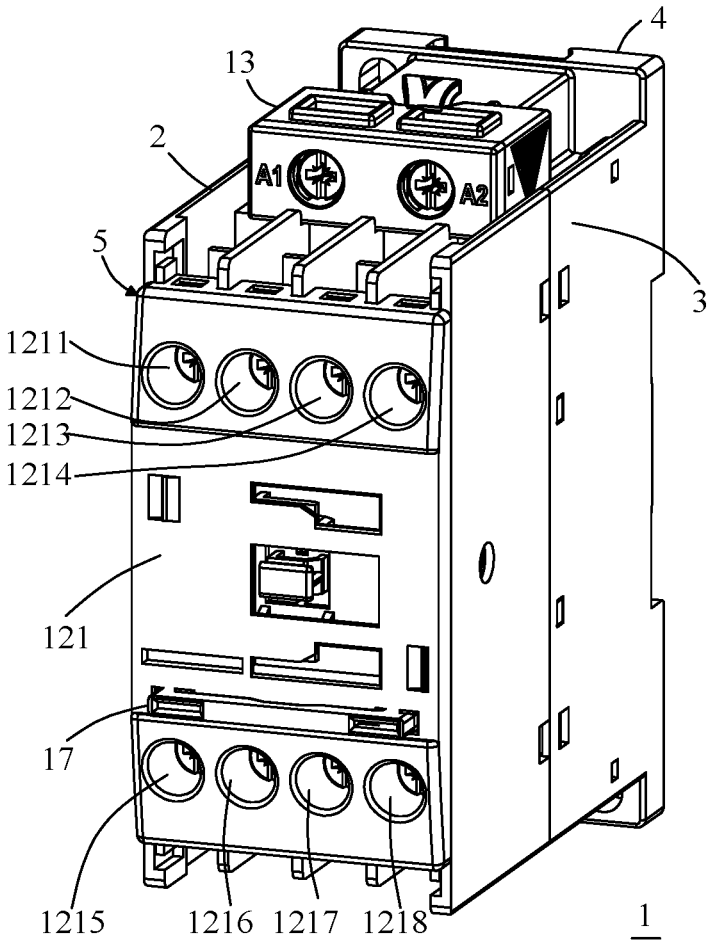
FIG. 1 is a schematic perspective view of a contactor according to an example embodiment of the present disclosure.

FIG. 1 is a schematic perspective view of a contactor according to an example embodiment of the present disclosure. As shown in FIG. 1, the contactor 1 includes a housing 5 and an auxiliary wiring module 13 located outside the housing 5. The housing 5 includes a side plate 2 and a side plate 3 which are arranged oppositely, an electrode top plate 121 and a mounting bottom plate 4 which are arranged oppositely, wherein the side plate 2, the side plate 3, the electrode top plate 121 and the mounting bottom plate 4 define a substantially cuboid accommodation space.

The contactor 1 further includes a static iron core, a moving iron core, a coil framework sleeved on the static iron core (described in combination with FIG. 6 and FIG. 7 below), an electromagnetic coil wound on the coil framework, a support member fixedly connected with the moving iron core, four identical moving contacts fixed on the support member, and four groups of identical static contacts corresponding to the four moving contacts in the accommodation space defined by the housing 5.

The shapes and structures of the static iron core, the moving iron core, the electromagnetic coil, the support member, the moving contact and the static contact in the contactor 1 of the present disclosure are the same as those of the exiting art, and will not be repeated herein. The operating principle of the contactor 1 is described as follows. A power supply supplies power to the electromagnetic coil inside the housing 5 through the auxiliary wiring module 13, the static iron core generates a magnetic force and attracts the moving iron core which simultaneously drives the support member and the four moving contacts to move in a direction getting close to the static iron core, so that the four moving contacts in the housing 5 are in contact with the four groups of static contacts in the housing 5 to realize an electrical connection, and the contactor 1 is in a conducting state at this time. When the power supply to the electromagnetic coil is disconnected or stopped, the static iron core releases the moving iron core, so that the four moving contacts are separated from the four groups of static contacts, and the contactor 1 is in a disconnected state at this time.

The electrode top plate 121 is provided with eight electrode through holes for electrode wires to pass through. The eight electrode through holes are arranged in two rows, with four electrode through holes 1211, 1212, 1213, and 1214 arranged in a first row being close to the auxiliary wiring module 13, and four electrode through holes 1215, 1216, 1217, and 1218 arranged in a second row being located below the four electrode through holes 1211, 1212, 1213, and 1214 in the first row.

The contactor 1 further includes a pluggable connecting device 17. One part of the pluggable connecting device 17 passes through the electrode top plate 121 to be inserted into the housing 5, and the other part of the pluggable connecting device 17 is located outside the housing 5 or arranged on the electrode top plate 121.

Figure 2:
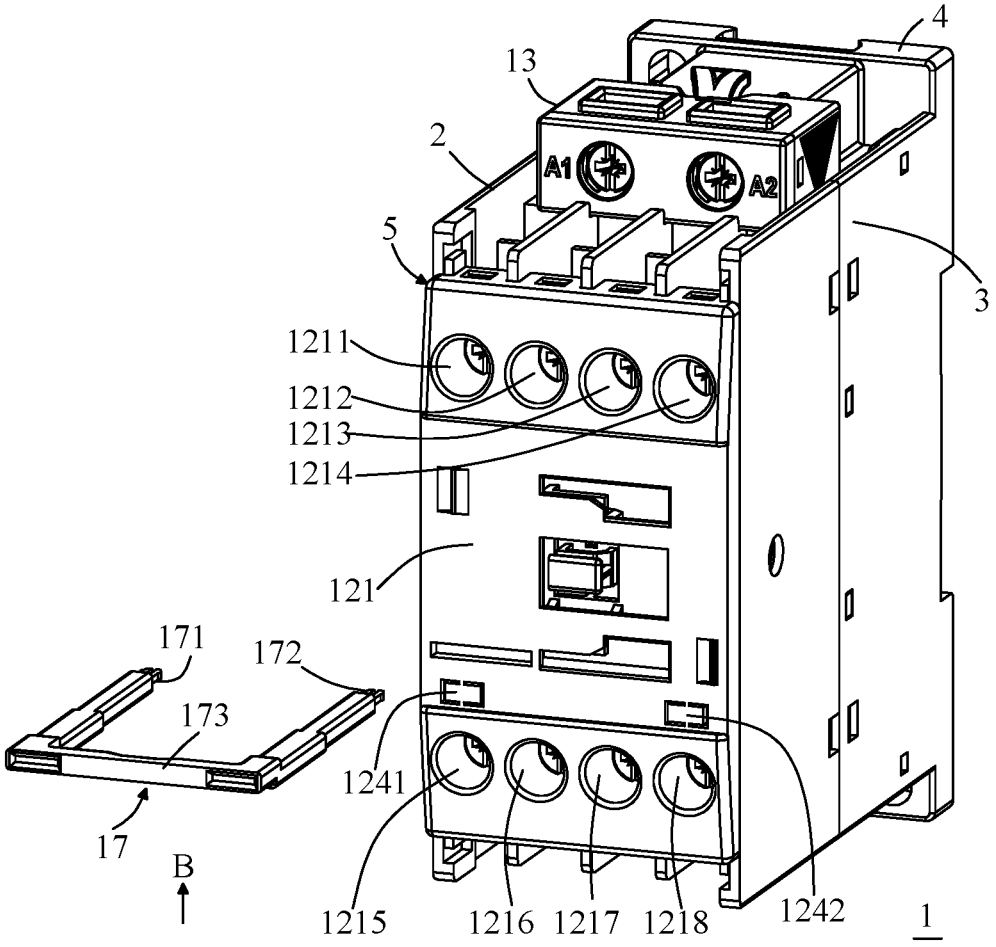
FIG. 2 is a schematic perspective view of a pluggable connecting device in the contactor shown in FIG. 1 after being pulled out of a housing.

FIG. 2 is a schematic perspective view of the pluggable connecting device 17 in the contactor shown in FIG. 1 after being pulled out of the housing 5. As shown in FIG. 2, the electrode top plate 121 is further provided with a first expansion hole 1241 and a second expansion hole 1242, and the first expansion hole 1241 and the second expansion hole 1242 are located between the first row of the electrode through holes and the second row of the electrode through holes.

The pluggable connecting device 17 is U-shaped, and the plane where the U-shaped pluggable connecting device 17 is located is perpendicular or substantially perpendicular to the plane where the electrode top plate 121 is located. The pluggable connecting device 17 includes an insulated connecting member 173, and a first conductive element 171 and a second conductive element 172 which are fixedly connected with the insulated connecting member 173. The first conductive element 171 and the second conductive element 172 are arranged oppositely in parallel. The first conductive element 171 is configured to be inserted into the interior of the housing 5 after passing through the first expansion hole 1241, and the second conductive element 172 is also configured to be inserted into the interior of the housing 5 after passing through the second expansion hole 1242.

Figure 3:
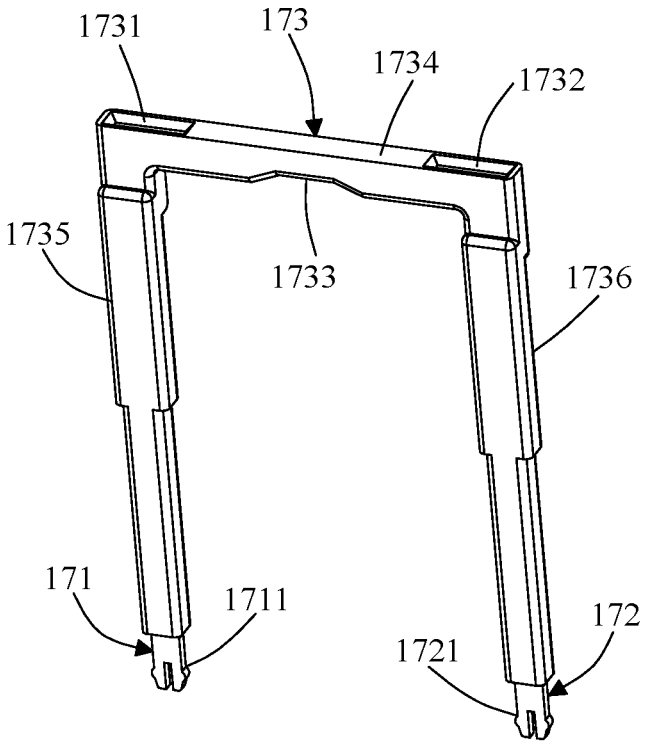
FIG. 3 is an enlarged schematic perspective view of the pluggable connecting device shown in FIG. 2 along a direction indicated by an arrow B.
Figure 4:
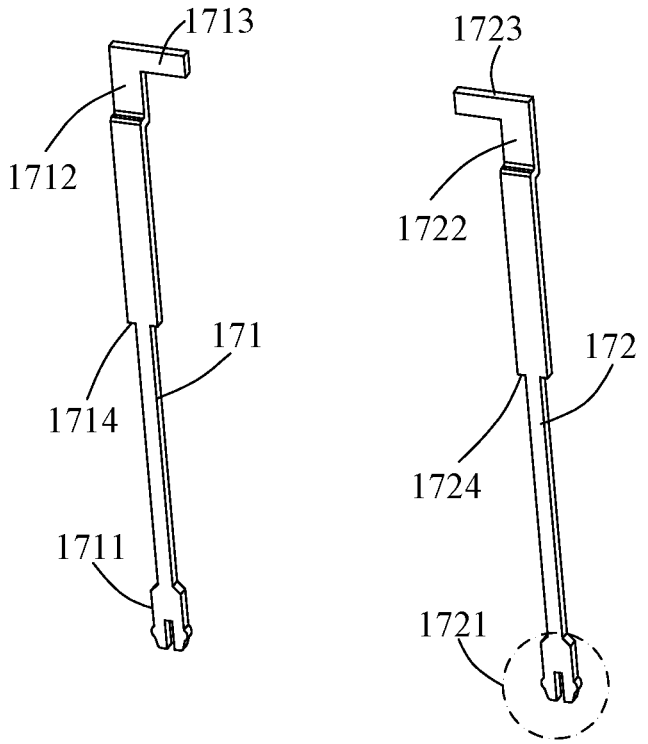
FIG. 4 is a schematic perspective view of the pluggable connecting device shown in FIG. 3 with an insulated connecting member removed.

FIG. 3 is an enlarged schematic perspective view of the pluggable connecting device shown in FIG. 2 along a direction indicated by an arrow B, and FIG. 4 is a schematic perspective view of the pluggable connecting device shown in FIG. 3 with the insulated connecting member removed. As shown in FIG. 3 and FIG. 4, the second conductive element 172 is strip-shaped and provided with an insertion end 1721 and a wiring end 1722 opposite to each other, and a step part 1724. The step part 1724 is located between the insertion end 1721 and the wiring end 1722, and the wiring end 1722 is provided with a bending part 1723 extending towards the first conductive element 171. The first conductive element 171 and the second conductive element 172 are mirror symmetrical, the first conductive element 171 is also provided with an insertion end 1711, a wiring end 1712 and a step part 1714, and the wiring end 1712 is provided with a bending part 1713 extending towards the second conductive element 172. When the insertion end 1711 and the insertion end 1721 pass through the first expansion hole 1241 and the second expansion hole 1242 respectively and are inserted into the interior of the housing 5, the wiring end 1712 and the wiring end 1722 are respectively located at an opening of the first expansion hole 1241 and an opening of the second expansion hole 1242, and the bending part 1713 and the bending part 1723 are located outside the housing 5 and serve as external connecting terminals of the contactor 1.

The insulated connecting member 173 is integrally molded by an insulated material through an injection molding process, and includes an operation connecting part 1734, and a first wrapping part 1735 and a second wrapping part 1736 which are fixedly connected with two ends of the operation connecting part 1734. The first wrapping part 1735 and the second wrapping part 1736 wrap a substantial portion of the first conductive element 171 and the second conductive element 172, respectively, so that only the insertion end 1711 of the first conductive element 171 and the insertion end 1721 of the second conductive element 172 are exposed and extend out.

One end of the operation connecting part 1734 defines a first accommodation space 1731 with an opening, and the other end defines a second accommodation space 1732 with an opening. The first accommodation space 1731 is configured to accommodate the bending part 1713 of the first conductive element 171, and the second accommodation space 1732 is configured to accommodate the bending part 1723 of the second conductive element 172. One wiring terminal of the power supply is placed in the first accommodation space 1731 and electrically connected with the bending part 1713 of the first conductive element 171, and the other wiring terminal of the power supply is placed in the second accommodation space 1732 and electrically connected with the bending part 1723 of the second conductive element 172, so that the voltage and current of the power supply will be transmitted to the insertion end 1711 and the insertion end 1721. The operation connecting part 1734 is provided with a recess 1733 on a side face opposite to the electrode top plate 121. When the insulated connecting member 173 is inserted into the first expansion hole 1241 and the second expansion hole 1242, an operable space is provided between the recess 1733 on the operation connecting part 1734 and the electrode top plate 121, which is convenient for an operation tool to pry the insulated connecting member 173 out of the housing 5 after the operation tool is inserted into the operable space, or suitable for an operator to pull out the insulated connecting member 173 by hand.

Figure 5:
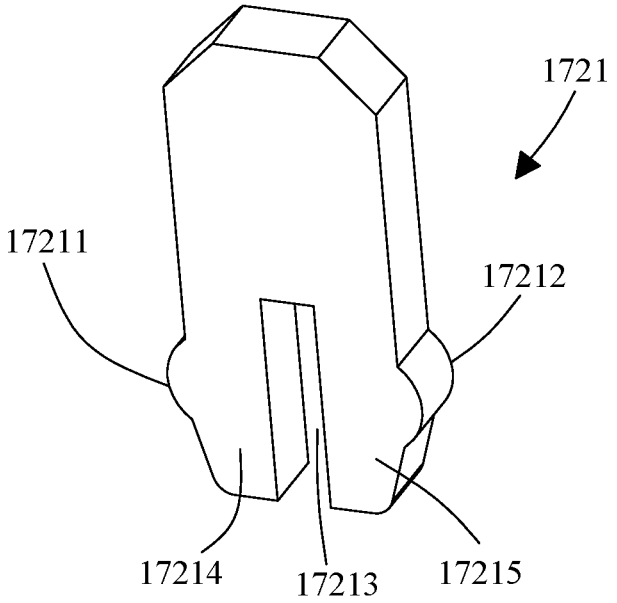
FIG. 5 is an enlarged schematic diagram of an insertion end of a second conductive element shown in FIG. 4.

FIG. 5 is an enlarged schematic diagram of the insertion end of the second conductive element 172 shown in FIG. 4. As shown in FIG. 5, the insertion end 1721 is provided with a clamping part 17214 and a clamping part 17215 which are arranged oppositely, and the clamping part 17214 and the clamping part 17215 are respectively provided with projections 17211 and 17212 located away from each other, and a slot 17213 is defined between the clamping part 17214 and the clamping part 17215. The clamping part 17214 and the clamping part 17215 have certain elastic deformation and elastic recovery ability. When a force directed to the projection 17212 is applied on the projection 17211 and/or a force directed to the projection 17211 is applied on the projection 17212, the distance between the projection 17211 and the projection 17212 becomes smaller. When the external force is removed, the projection 17211 and the projection 17212 will return to their original position.

Figure 6:
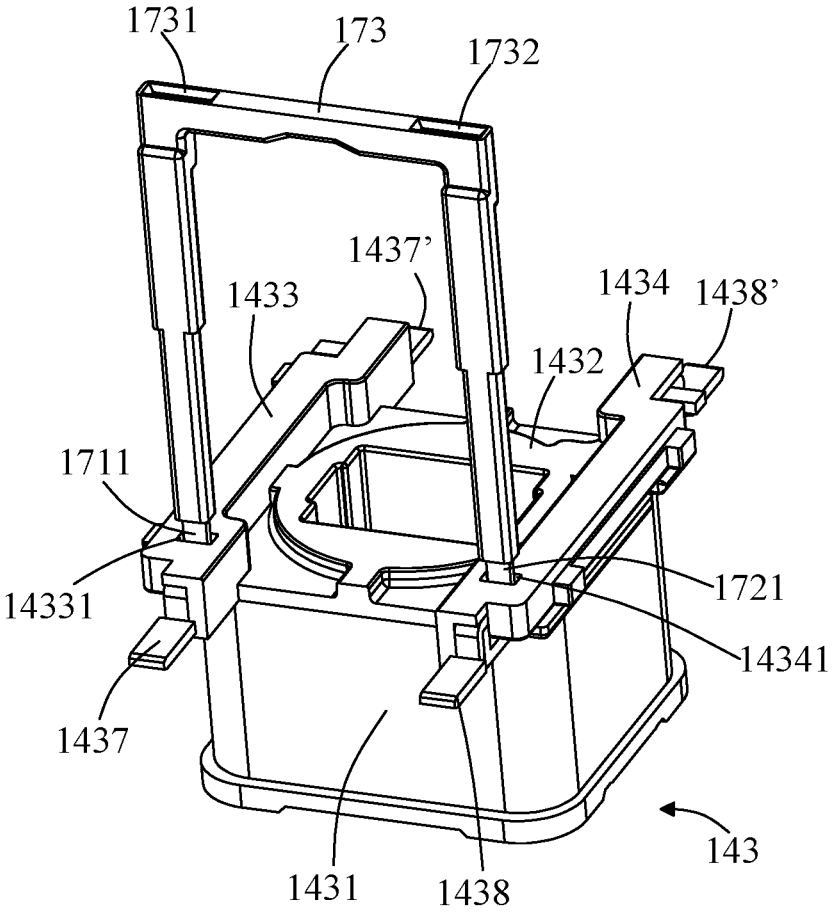
FIG. 6 is a schematic perspective view of a coil framework and an insulated connecting member in the contactor shown in FIG. 1.

FIG. 6 is a schematic perspective view of a coil framework and an insulated connecting member in the contactor shown in FIG. 1.

Figure 7:
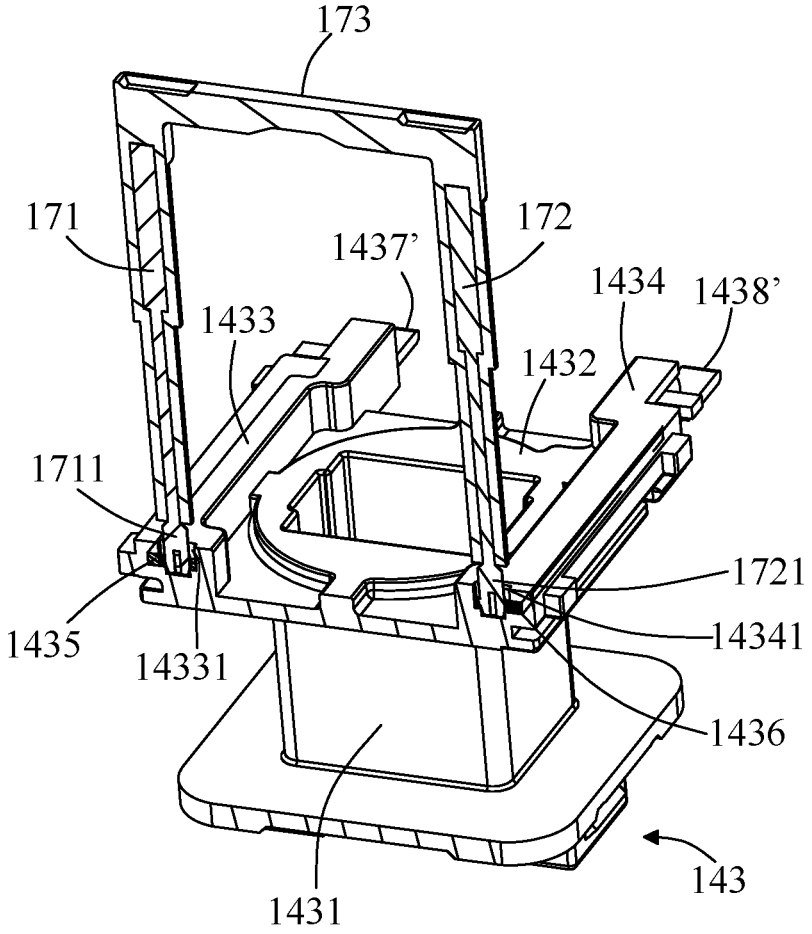
FIG. 7 is a cross-sectional view of the coil framework and the insulated connecting member shown in FIG. 6 with the sectional plane passing through two insertion ends of the insulated connecting member.

FIG. 7 is a cross-sectional view of the coil framework and the insulated connecting member shown in FIG. 6 with a sectional plane passing through two insertion ends of the insulated connecting member. As shown in FIG. 6 and FIG. 7, the coil framework 143 is integrally molded, which includes a framework body 1431, a first fixing part 1433 and a second fixing part 1434. The framework body 1431 is substantially in a shape of an annular column, and provided with an end face 1432 facing the moving iron core and the support member (not shown in FIG. 6 and FIG. 7). The first fixing part 1433 and the second fixing part 1434 are substantially rod-shaped and are oppositely fixed on an edge of the end face 1432 of the framework body 1431, respectively. The first fixing part 1433 and the second fixing part 1434 are respectively provided with an auxiliary hole 14331 and an auxiliary hole 14341, and the opening of the auxiliary hole 14331 and the opening of the auxiliary hole 14341 face the electrode top plate 121, and are aligned with the first expansion hole 1241 and the second expansion hole 1242 on the electrode top plate 121, respectively.

The coil framework 143 further includes a first connecting sheet 1435 and a second connecting sheet 1436 made of metal material, and an electromagnetic coil (not shown in FIG. 6 and FIG. 7) wound on the coil framework 143. The first connecting sheet 1435 and the first fixing part 1433 are fixed together by the injection molding process, and two ends 1437 and 1437' of the first connecting sheet 1435 protrude from the two ends of the first fixing part 1433. Similarly, the second connecting sheet 1436 and the second fixing part 1434 are fixed together by the injection molding process, and two ends 1438 and 1438' of the second connecting sheet 1436 protrude from the two ends of the second fixing part 1434. One end 1437 of the first connecting sheet 1435 and one end 1438 of the second connecting sheet 1436 are configured to be electrically connected with two connecting terminals in the auxiliary wiring module 13. Two ends of the electromagnetic coil are electrically connected with the first connecting sheet 1435 and the second connecting sheet 1436, respectively.

The insertion end 1711 of the first conductive element 171 and the insertion end 1721 of the second conductive element 172 respectively pass through the first expansion hole 1241 and the second expansion hole 1242 of the electrode top plate 121 (as shown in FIG. 2), and are inserted into the auxiliary hole 14331 and the auxiliary hole 14341 respectively, so as to realize the electrical connection with the first connecting sheet 1435 and the second connecting sheet 1436.

Figure 8:
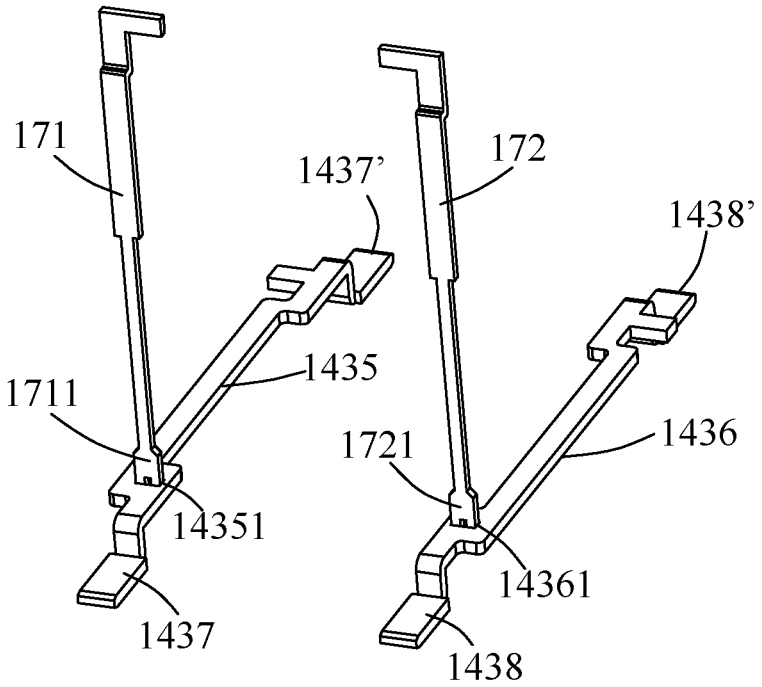
FIG. 8 is a schematic perspective view of a first connecting sheet, a second connecting sheet, a first conductive element and a second conductive element in the coil framework and the insulated connecting member shown in FIG. 6.
Figure 9:
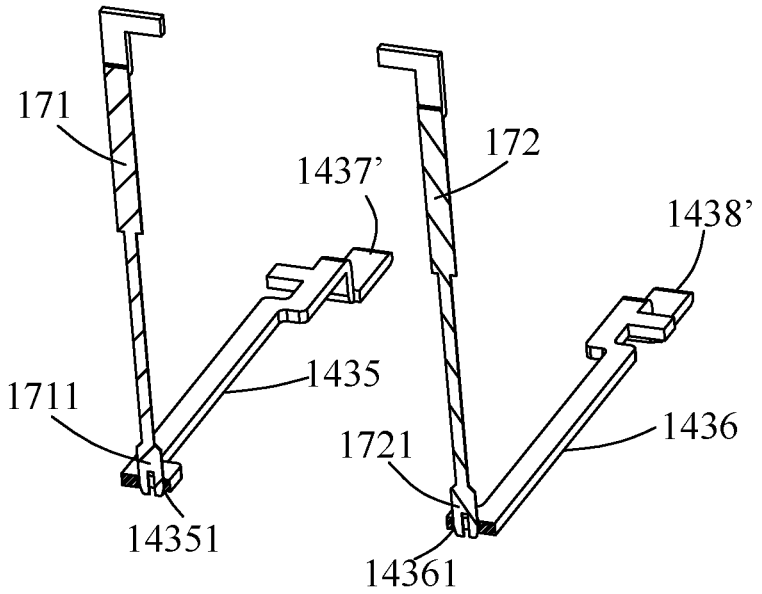
FIG. 9 is a cross-sectional view of the first connecting sheet, the second connecting sheet, the first conductive element and the second conductive element shown in FIG. 8 with the sectional plane passing through the two insertion ends of the insulated connecting member.

FIG. 8 is a schematic perspective view of the first connecting sheet, the second connecting sheet, the first conductive element and the second conductive element in the coil framework and the insulated connecting member shown in FIG. 6. FIG. 9 is a cross-sectional view of the first connecting sheet, the second connecting sheet, the first conductive element and the second conductive element shown in FIG. 8 with a sectional plane passing through the two insertion ends of the insulated connecting member. As shown in FIG. 8 and FIG. 9, the first connecting sheet 1435 is provided with a through hole 14351 aligned with the auxiliary hole 14331 of the first fixing part 1433, and the second connecting sheet 1436 is provided with a through hole 14361 aligned with the auxiliary hole 14341 of the second fixing part 1434.

During the insertion process of the insertion end 1711 of the first conductive element 171, the two projections on the insertion end 1711 first come in to contact with the opening of the auxiliary hole 14331, and the then auxiliary hole 14331 squeezes the two projections on the insertion end 1711, so that the distance between the two projections becomes smaller. Thus, the insertion end 1711 can be further inserted into the through hole 14351 of the first connecting 1435. Since the insertion end 1711 has a certain elastic recovery ability, the two projections on the insertion end 1711 will abut against or cling to the inner wall of the through hole 14351 of the first connecting sheet 1435. The deformation of the insertion end 1721 of the second conductive element 172 during insertion is the same as that of the insertion end 1711, and will not be repeated here. Finally, the first conductive element 171 and the second conductive element 172 achieve good mechanical contact and reliable electrical connection with the first connecting sheet 1435 and the second connecting sheet 1436, respectively.

Referring to FIG. 1 and FIG. 2 again, when the mounting bottom plate 4 of the contactor 1 is fixedly mounted in a cabinet body in the mounting manner shown in FIG. 1, if other circuit modules are inconvenient to be electrically connected with the auxiliary wiring module 13 or the electrical signal in the electromagnetic coil needs to be monitored, the pluggable connecting device 17 may be inserted into the interior of the housing 5 from the first expansion hole 1241 and the second expansion hole 1242 in the electrode top plate 121 until the two insertion ends 1711 and 1721 of the pluggable connecting device 17 are embedded into the through hole 14351 of the first connecting sheet 1435 and the through hole 14361 of the second connecting sheet 1436, respectively. Thus, the first conductive element 171, the first connecting sheet 1435, the electromagnetic coil, the second connecting sheet 1436 and the second conductive element 172 form a conductive path, and the bending part 1713 of the first conductive element 171 and the bending part 1723 of the second conductive element 172 are used as the external connecting terminals of the contactor 1. According to actual needs, the two wiring terminals of the power supply may be connected with the bending part 1713 of the first conductive element 171 and the bending part 1723 of the second conductive element 172 respectively, which can be conveniently wired above the electrode top plate 121 of the contactor 1 to supply power or stop supplying power to the electromagnetic coil inside the contactor 1. The electric signal in the electromagnetic coil may also be acquired from the bending part 1713 of the first conductive element 171 and the bending part 1723 of the second conductive element 172, so as to facilitate the monitoring of the electric signal in the electromagnetic coil or the on-off state of the contactor 1.

When the pluggable connecting device 17 needs to be replaced or is not required to be installed, a force away from the electrode top plate 121 is applied to the operation connecting part 1734 to pull out the pluggable connecting device 17.

The pluggable connecting device 17 is integrally molded, and has a firm structure. It is convenient for the operator to insert the pluggable connecting device 17 into and pull out from the contactor 1.

The insulated connecting member 173 in the pluggable connecting device 17 wraps or covers the first conductive element 171 and the second conductive element 172, which may prevent the first conductive element 171 and the second conductive element 172 from being electrically connected with other conductive components in the limited space in the contactor 1.

The operation connecting part 1734 is made of an insulating material, which is convenient for the operator to operate by hand directly. The recess 1733 on the operation connecting part 1734 is convenient for the operator to pull the pluggable connecting device 17 out of the contactor 1, and no additional components are added, so that the structure is simple and the manufacturing cost is low.

The first conductive element 171 and the second conductive element 172 are respectively provided with a bending part, which increase their contact region or contact area with external circuit modules. The bending part of the first conductive element 171 and the bending part of the second conductive element 172 are located in the first accommodation space 1731 and the second accommodation space 1732 defined by the operation connecting part 1734, thereby avoiding the risk of electric shock caused by accidentally touching the first conductive element 171 and the second conductive element 172.

The insertion end 1711 of the first conductive element 171 and the insertion end 1721 of the second conductive element 172 are respectively provided with a slot, so that the insertion end 1711 and the insertion end 1721 have certain elastic deformation and elastic recovery ability, and the insertion end 1711 and the insertion end 1721 can form good mechanical contact with the first connecting sheet 1435 and the second connecting sheet 1436 under the action of elastic restoring force. The projections on the insertion end 1711 and the insertion end 1721 can further enhance the mechanical contact and electrical connection, and ensure reliable electrical conductivity.

The first conductive element 171 and the second conductive element 172 are respectively provided with a step part, so that the contact between the injection-molded insulated connecting member 173 and the first conductive element 171 and the contact between the injection-molded insulated connecting member 173 and the second conductive element 172 are more firm, thereby avoiding falling off.

In other embodiments of the present disclosure, specific size parameters of the first conductive element 171 and the second conductive element 172, as well as the number and position of the step parts, are designed according to an internal installation space of the housing 5.

The above description is only example embodiments of the present disclosure, and is not intended to be limited to the embodiments described here. Any modifications and changes made without departing from the scope of the present disclosure shall fall within the scope of the present disclosure.

What is claimed is:

1. A pluggable connecting device for connecting to a coil of a contactor that comprises a housing having a top electrode plate and a coil framework in the housing, the coil framework comprising an annular column around which a coil is wound and having an opening facing the top electrode plate and first and second connecting sheets on a surface of the coil framework on opposite sides of the opening facing the top electrode plate, the connecting device comprising:

an insulated connecting member; and a first conductive element and a second conductive element fixedly connected to respective ends of the insulated connecting member, wherein the first conductive element has an insertion end and a wiring end at opposite ends thereof, wherein the second conductive element has an insertion end and a wiring end at opposite ends thereof, wherein the insertion end of the first conductive element and the insertion end of the second conductive element are configured to be inserted into the housing through respective first and second openings in the top electrode plate to connect to the first connecting sheet and the second connecting sheet, respectively, wherein the insertion end of the first conductive element is provided with two first clamping parts arranged oppositely, wherein a slot is defined between the two first clamping parts, wherein the insertion end of the second conductive element is provided with two second clamping parts arranged oppositely, wherein a slot is defined between the two second clamping parts, wherein the two first clamping parts are respectively provided with two projections away from each other, and wherein the two second clamping parts are respectively provided with two projections away from each other.

2. The pluggable connecting device according to claim 1, wherein the pluggable connecting device is U-shaped.

3. The pluggable connecting device according to claim 1, wherein the first conductive element comprises a step part arranged between the insertion end and the wiring end of the first conductive element, and wherein the second conductive element comprises a step part arranged between the insertion end and the wiring end of the second conductive element.

4. A pluggable connecting device for connecting to a coil of a contactor that comprises a housing having a top electrode plate and a coil framework in the housing, the coil framework comprising an annular column around which a coil is wound and having an opening facing the top electrode plate and first and second connecting sheets on a surface of the coil framework on opposite sides of the opening facing the top electrode plate, the connecting device comprising:

an insulated connecting member; and a first conductive element and a second conductive element fixedly connected to respective ends of the insulated connecting member, wherein the first conductive element has an insertion end and a wiring end at opposite ends thereof, wherein the second conductive element has an insertion end and a wiring end at opposite ends thereof, wherein the insertion end of the first conductive element and the insertion end of the second conductive element are configured to be inserted into the housing through respective first and second openings in the top electrode plate to connect to the first connecting sheet and the second connecting sheet, respectively, wherein the wiring end of the first conductive element is provided with a bending part, wherein the wiring end of the second conductive element is provided with a bending part, and wherein the bending part of the first conductive element and the bending part of the second conductive element extend in a direction getting close to each other.

5. The pluggable connecting device according to claim 4, wherein the insulated connecting member is molded by injection molding and comprises an operation connecting part, and a first wrapping part and a second wrapping part which are fixedly connected with two ends of the operation connecting part, wherein the first wrapping part wraps the first conductive element and makes the insertion end of the first conductive element extend out, and the second wrapping part wraps the second conductive element and makes the insertion end of the second conductive element extend out.

6. The pluggable connecting device according to claim 5, wherein one end of the operation connecting part defines a first accommodation space with an opening, and another end of the operation connecting part defines a second accommodation space with an opening, wherein the bending part of the first conductive element is located in the first accommodation space, and the bending part of the second conductive element is located in the second accommodation space.

7. The pluggable connecting device according to claim 5, wherein the operation connecting part is provided with a recess arranged opposite to the housing.

8. A contactor comprising:

a housing comprising an electrode top plate and a mounting bottom plate which are arranged oppositely, the electrode top plate being provided with a first expansion hole and a second expansion hole; and a coil framework located inside the housing, the coil framework comprising an annular column around which a coil is wound and having an opening facing the top electrode plate and a first connecting sheet and a second connecting sheet on the annular column on opposite sides of the opening and facing the top electrode plate and having contacts aligned with the first expansion hole and the second expansion hole, respectively, such that first and second conductive elements inserted in respective ones of the first and second expansion holes are electrically connected to the first connecting sheet and the second connecting sheet, respectively, wherein the coil framework comprises a framework body, a first fixing part and a second fixing part which are fixed on an end face of the framework body, wherein the first connecting sheet and the second connecting sheet are respectively fixed in the first fixing part and the second fixing part, wherein the first connecting sheet and the first fixing part are respectively provided with a first through hole and a first auxiliary hole which are aligned with the first expansion hole, and wherein the second connecting sheet and the second fixing part are respectively provided with a second through hole and a second auxiliary hole which are aligned with the second expansion hole.

* * * * *